US005526879A

United States Patent [19]

Champ et al.

[11] Patent Number: 5,526,879

[45] Date of Patent: Jun. 18, 1996

[54] INTRODUCTION OF PARTICULATE MATERIAL INTO A BOREHOLE

[75] Inventors: Jamieson E. Champ; William S. Burrows, both of Georgetown; Andrew R. Dobson, Glen Williams, all of Canada

[73] Assignee: Solinst Canada Limited, Georgetown, Canada

[21] Appl. No.: 78,899

[22] Filed: Jun. 21, 1993

[30] Foreign Application Priority Data

Jun. 22, 1992 [GB] United Kingdom ..... 9213188

[51] Int. Cl.[6] ..... E21B 43/02

[52] U.S. Cl. ..... 166/278; 137/268; 166/51; 166/75.15

[58] Field of Search ..... 166/278, 51, 70, 166/90, 75.15; 137/268; 51/436, 437, 438

[56] References Cited

U.S. PATENT DOCUMENTS

| | | | |
|---|---|---|---|
| 911,431 | 2/1909 | Nichols | 51/436 |
| 1,427,206 | 8/1922 | Green | 51/436 |
| 1,858,561 | 5/1932 | Ruemelin | 51/436 |
| 1,980,632 | 11/1934 | Peeples | 166/51 X |
| 2,014,770 | 9/1935 | Layne | 166/51 |
| 2,372,461 | 3/1945 | Uren | 166/51 |
| 2,938,305 | 5/1960 | Bipes | 137/268 |
| 3,139,705 | 7/1964 | Histed | 51/427 X |
| 4,512,405 | 4/1985 | Sweatman | 166/278 |
| 4,751,969 | 6/1988 | Klaeger | 166/53 X |
| 5,078,212 | 1/1992 | Boyle et al. | 166/278 |
| 5,105,743 | 4/1992 | Tano et al. | 102/313 |

FOREIGN PATENT DOCUMENTS

| | | |
|---|---|---|
| 496422 | 4/1930 | Germany . |
| 928760 | 6/1955 | Germany . |
| 879303 | 10/1961 | United Kingdom . |
| 1216507 | 12/1970 | United Kingdom . |
| 1519374 | 7/1978 | United Kingdom . |
| 2114526 | 8/1983 | United Kingdom . |
| 2183210 | 6/1987 | United Kingdom . |

*Primary Examiner*—Hoang C. Dang
*Attorney, Agent, or Firm*—Anthony Asquith & Co.

[57] ABSTRACT

Bentonite, and other water-sensitive materials in granulate form, are introduced into boreholes. The material is borne into the borehole through a conduit, in which a flow of air (or nitrogen) not only transports the material but also keeps water that may be present in the borehole from entering the conduit. The materials are contained, above ground, in hoppers arranged to feed in parallel into the conduit. Material from a selected hopper enters via a respective valve into the conduit. The hoppers are pressurized to ensure the moving gases in the conduit do not enter the fall pipe. Having turned the air on, the technician lowers the conduit to the bottom of the borehole; then he opens the valve to admit the selected filler material; then he withdraws the conduit gradually and progressively up the borehole, depositing the material. The conduit is of flexible material, and can be held in the hand, to assist in sensing the flow of material.

19 Claims, 4 Drawing Sheets

INTRODUCTION OF PARTICULATE MATERIAL INTO A BOREHOLE

The invention relates to the preparation and use of wells and other boreholes, particularly of the kind that are used for the purpose of monitoring the parameters of groundwater.

In such boreholes, the requirement often arises for portions of the borehole to be packed with material that is introduced, in granulate or particulate form, from the surface. The material may be introduced for the purpose of anchoring some piece of equipment in place, or for the purpose of isolating a particular sampling depth, or for the purpose of sealing the borehole and rendering conditions in the borehole, as much as possible, as they were before the ground was disturbed.

Previous known systems for introducing particulate materials into boreholes have amounted to hardly more than simply pouring or tipping the material into the borehole from the surface. One problem is that the particulate material may be material of the kind (e.g. bentonite) that swells upon contact with water. If bentonite is fed through a pipe, for example, any moisture in the pipe soon causes the bentonite to adhere to the walls of the pipe, swell up, and restrict or even block the pipe. It is of course all too easy for moisture to enter a pipe in a borehole in the ground.

Another previously known system has involved placing a tube in the borehole, and pumping a slurry of bentonite grout down the tube. Apart from the expense of providing a suitable slurry pump, the disadvantages of this system are first that the bentonite has to be mixed with water prior to being pumped, which means that the bentonite is saturated, and much of its swelling capacity expanded, before the material enters the borehole; and second that the water for mixing the bentonite is often not readily available on-site, but has to be tucked to the site.

One of the aims of the invention is to so introduce bentonite into the borehole that this bentonite can remain dry right up until the moment it is deposited, gently, on top of the already-deposited bentonite.

GENERAL FEATURES OF THE INVENTION

The invention represents a development of the technology illustrated in U.S. Pat. No. 5,078,212 (BOYLE, issued Jan. 7, 1992).

In the invention, the material to be fed into the borehole is contained, above ground, in a hopper. A conduit for conveying the material from the hopper is provided. The conduit is lowered down into the borehole to the depth at which the material is to be placed. The conduit is connected to a source of gas pressure, whereby a flow of gas is blown through the conduit, and down into the borehole. The arrangement of the apparatus is such that the granular material is borne down into the borehole along with the said flow of gas. The gas may be air or, for example, nitrogen.

The lower end of the conduit may be positioned, in the borehole, somewhat above the location at which the material is to be placed; but preferably the end of the conduit should be placed substantially just at the depth at which it is desired to place the material; if the end of the conduit is higher, and the material is allowed to fall down the borehole until it settles, some of the material might adhere to the wet sides of the borehole, which might affect the density of packing of the material below.

Often, it is desired to create, in the borehole, a sampling zone, in which a draw-off port is provided for drawing off a sample of the groundwater at a particular depth, which is then conveyed to the surface: in such a case, the sampling zone would include a layer of sand, in which the draw-off port is embedded, the layer of sand being sealed, above and below, by respective layers of bentonite. The invention however should not be construed as being limited only to the provision of such ordered layers of materials (although the invention is excellent in its applicability to that case); the invention can be used generally where it is desired to introduce virtually any form of particulate of granulate material into a borehole.

Preferably, the hopper is set up so that the material in the hopper drains out through a fall pipe. A valve controls the passage of the material into the fall pipe. The fall pipe and the conduit are joined at a junction, and the material falls from the fall pipe into the junction and thence into the conduit.

One of the difficulties with which the designer of an apparatus for feeding water-sensitive, particulate materials must contend is to keep the materials dry. The fast-moving gases in the conduit have a tendency to swirl up into the fall pipe; it is almost moisture, and if the gas can collect in a static pocket somewhere in the apparatus, the possibility arises that the moisture will be deposited in that pocket. The designer should take precautions to keep the gas as dry as possible.

In an apparatus for delivering material which expands upon contact with water, it is to be preferred that no such pockets are created, and especially that such pockets be not created in such critical areas as the fall pipe and valve area. In the invention, the aim is that this area be kept dry: the shape of the junction is such that the momentum of the flowing gases does not carry the gases into the mouth of the fall pipe, but instead the momentum of the gases diverts the gases away from the mouth of the fall pipe.

In another aspect of the invention, again in furtherance of the aim that the fall pipe and valve area be kept dry, and that the flow of materials be smooth and gentle, a pressure is maintained in the hopper, whereby no suction effect is produced which might tend to draw gases form the conduit up into the hopper, and up into the fall pipe and valve area.

In another aspect of the invention, more than one hopper is provided. The hoppers are arranged in parallel, each feeding into the conduit, and the flow of material from each hopper is controlled by a respective valve. Thus, the material to be fed into the borehole may be selected simply by opening the appropriate one of the valves. This is preferable to the case, as in BOYLE, where only one hopper is provided, and where new material consequently has to be placed in the same hopper. Apart from being inconvenient, the danger in this case is that even slight carelessness on the part of the operator can easily lead to an interruption in the gas flows and pressures within the conduit, and a consequent clogging up of the pipes and conduits.

The importance of preventing or reducing this possibility lies mainly in the fact that it is not clear to the operator that a problem has occurred, and the operator can easily be led to think that the borehole is being properly filled with material when in fact the material has started to settle, and to swell, in the wrong place. Once the material has become wetted, and has started to swell, it is usually very difficult to remove it.

The aim is that, once the filling of the borehole has commenced, the operator should be able to change over, e.g. from sand to bentonite, in such a way that the chance of his accidentally interrupting the gas flow is eliminated, or kept to a minimum. In the invention, the change of materials is accomplished simply by operating the hopper valves: the operator is not at that time devoting part of his attention to seeing that the pressure in the hopper is maintained, nor with seeing that the flow of gas in the conduit is maintained.

In another aspect of the invention, the hopper or hoppers are disposed away form the mouth of the borehole, i.e. the hoppers are off-set to one side. Thus, access is provided to the top of the borehole for the operator to pass the conduit down into the borehole while holding the conduit in his hands. This leads to much more convenient operation than was possible in BOYLE, for example. The operator can progressively withdraw the conduit out of the borehole, as the borehole is filled with deposited granular material, and the length of the conduit withdrawn can lie coiled or otherwise stored at the surface, while pressure continues to be supplied to the conduit.

DETAILED DESCRIPTION OF PREFERRED EMBODIMENT

By way of further explanation of the invention, exemplary embodiments of the invention will now be described with reference to the accompanying drawings, in which.

Figures 5A, 5B, 5C:
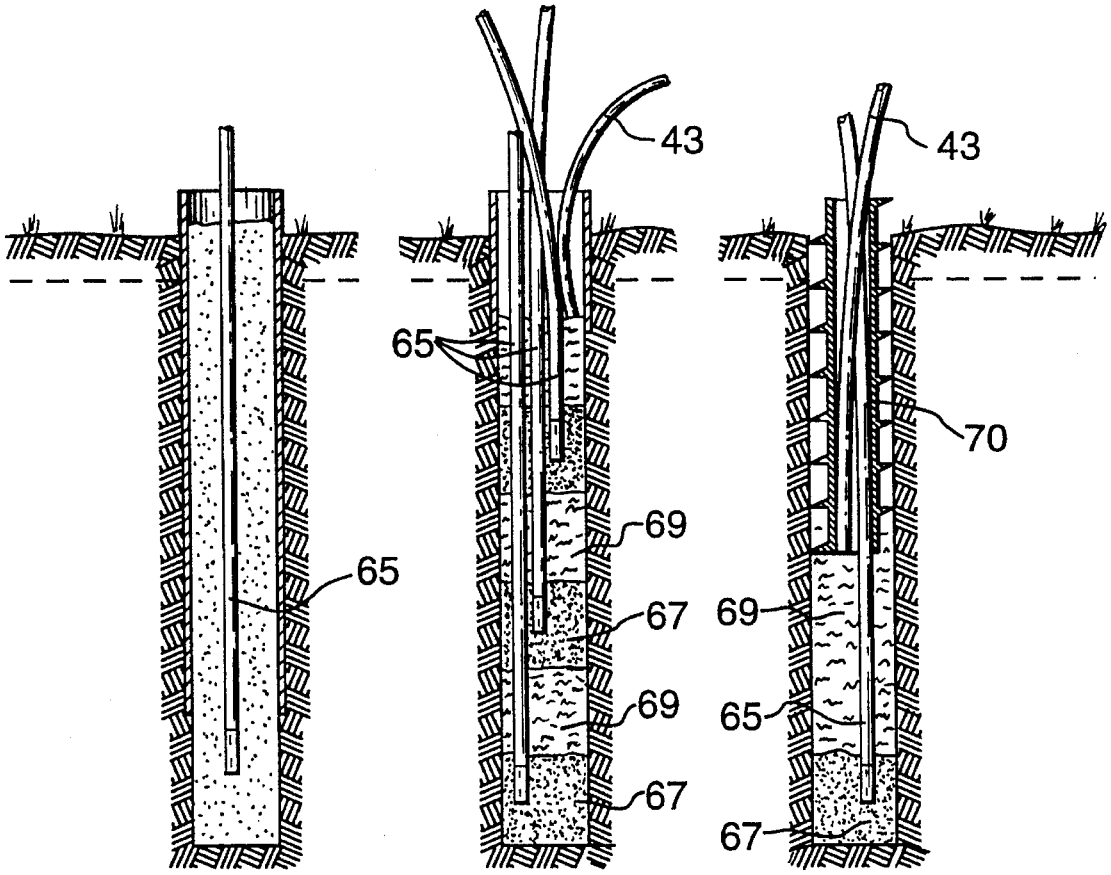

FIGS. 5A, 5B, and 5C are cross-sections of various boreholes, showing the invention in different configurations.

The apparatuses shown in the accompanying drawings and described below are examples which embody the invention. It should be noted that the scope of the invention is defined by the accompanying claims, and not necessarily by specific features of exemplary embodiments.

Figure 1:
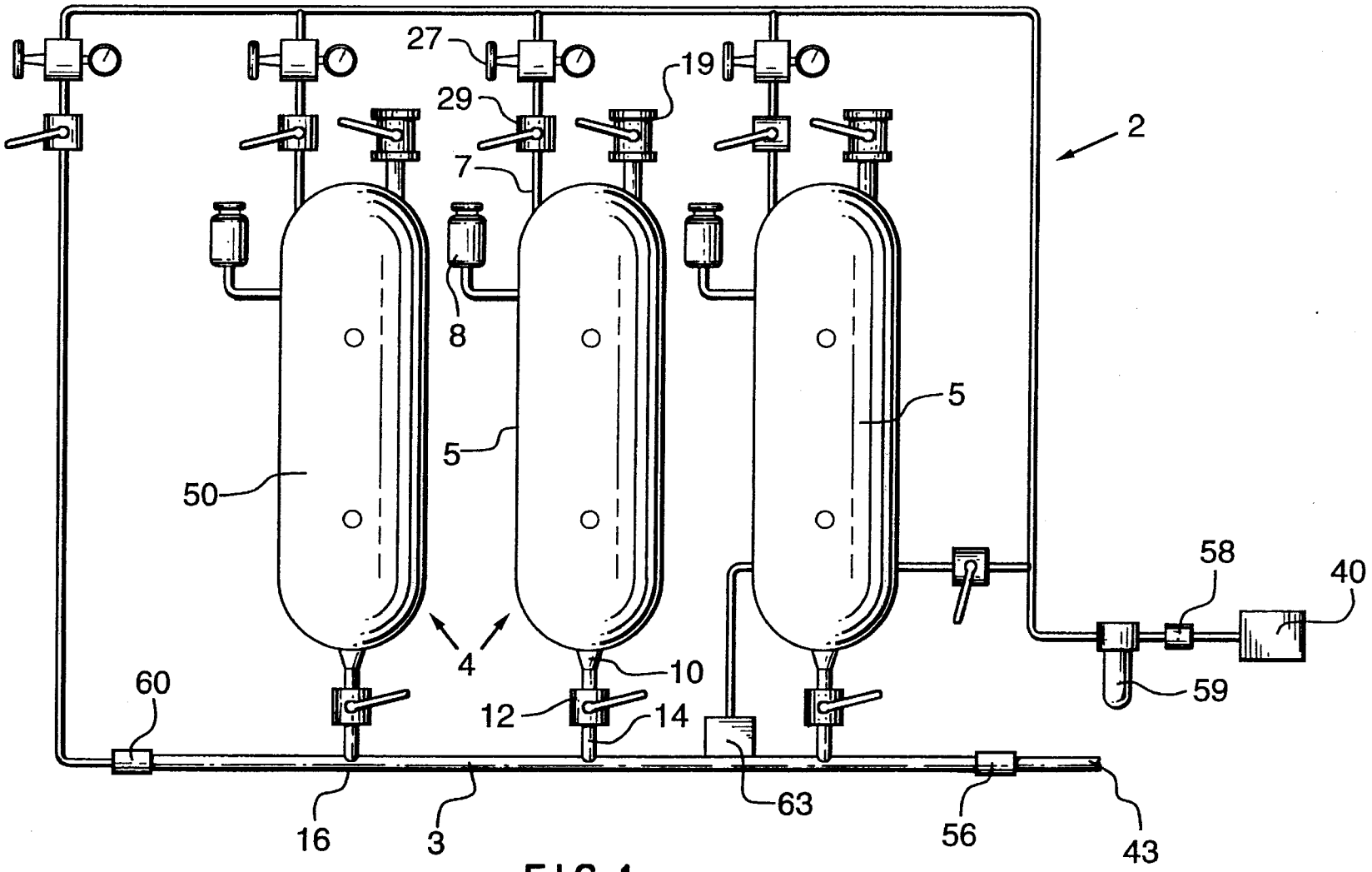
FIG. 1 is a schematic diagram of a particle placement system which embodies the invention.

The apparatus shown in FIG. 1 includes a hopper unit 2. This unit is located above ground, and includes pressure gauges, flow regulators, and other items. The unit also includes, or is coupled to, a source of compressed gas, being, for example, an air compressor or a pressurized bottle of air or nitrogen.

The unit 2 feeds gas into a conduit 3. The remote end of the conduit 3 passes down into the borehole (not shown). The supply of gas is of such pressure and velocity and flow rate as to keep the conduit 3 full of fast-moving gases, whereby the conduit is kept substantially completely dry and free from the ingress into the conduit of any water which might be present in the borehole.

Figure 2:
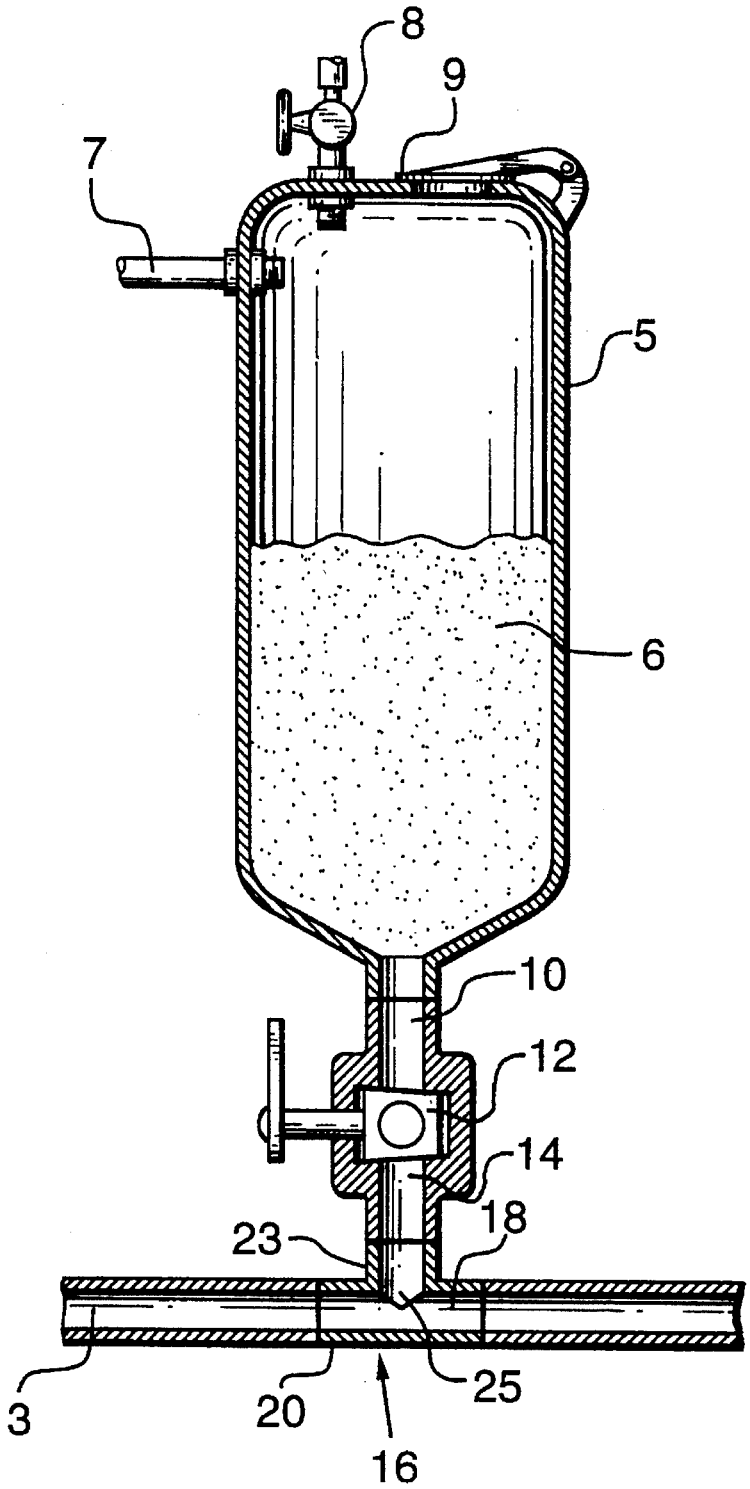
FIG. 2 is a close-up cross-section of one of the hopper feed valves of the said system.

The apparatus also includes three hopper assemblies 4. One of the assemblies 4 is shown in more detail in FIG. 2. (The FIG. 2 hopper assembly is a minor variation of those shown in FIG. 1.) The hopper assembly 4 includes a hopper 5, which comprises a receptacle for a body 6 of granulate or particulate material, such as sand or bentonite.

The hopper 5 also comprises a pressure vessel. The hopper is enclosed, and a feed pipe 7 conveys gas (air or nitrogen) under pressure form the supply source 40. The hopper assembly 4 includes a pressure relief valve 8, and a sealed lid 9 which can be opened (after the pressure in the hopper 5 has been released) to admit a fresh supply of material. Alternatively, an air-lock re-filling system may be used in place of the simple lid 9, whereby the hopper may be replenished without the need to release the pressure in the hopper. Windows in the hopper allow a technician to determine when replenishment is required.

At the foot of the hopper 5 is a drain pipe 10. The drain pipe 10 leads into a material-flow control valve 12; the material collects, under gravity, in the drain pipe 10, and from there falls to the valve 12.

If the valve 12 is open, the material falls through the valve, and into a fall pipe 14. The fall pipe 14 is connected at a junction 16 to the conduit 3. The junction 16 includes a T-piece 18. The bar 20 of the T-piece 18 is a component of the conduit 3, and the (inverted) leg 23 of the T-piece is a component of the fall pipe 14.

The arrangement of the junction 16 is such that, at the intersection of the fall pipe 14 with the conduit 3, the exit mouth 25 of the fall pipe 14 opens directly into the conduit 3. Thus, granulate or particulate material present in the fall pipe 14 falls (under gravity) right into the conduit 3. Once in the conduit 3, the material is swept along and down the borehole by the velocity of the gas flow in the conduit.

The pressure of the gas supplied to the hopper 5 must not be of too small a magnitude: the pressure should be high enough that the rushing gases in the conduit, as they pass by the mouth of the fall pipe, are not drawn into the mouth of the fall pipe.

The design of the T-piece 18 also should be such that the rushing gases in the conduit do not tend to enter the mouth of the fall pipe by virtue of their own momentum. Arranging the bar and leg of the T-piece as shown has been found to be effective to prevent substantially any tendency for the rushing gases to enter the fall pipe.

If the rushing gases in the fall pipe were allowed to encroach into the mouth of the fall pipe, the tendency would be for the particulate material to be blown back up the fall pipe. The aim is rather that the material fall freely and cleanly through the valve, as smoothly as possible.

The pressure of gas in the hopper could, if the need arose, be increased momentarily; for example, to blast clear any material that might have started to adhere around the valve or pipes.

As shown in FIG. 1, the illustrated apparatus includes three hopper assemblies, each with its own material control valve 12. Thus, one of the hoppers 5 may contain sand, another may contain bentonite, while a third contains some other appropriate granular or particulate material, for example bentonite of a different grain size, or a prepared proportionate mixture of sand and bentonite. The third hopper may contain compressed air, as described below.

In operation of the apparatus, first the supply unit is activated so that gas flows into and through the conduit 3. With the gas emerging from the remote end of the conduit 3, that end is lowered into the borehole. Any water that may be present in the borehole in thus prevented form entering the conduit 3. As the conduit is lowered into the water in the borehole, the pressure of the gas should be increased in correspondence to the increasing pressure of the water, to ensure that the flow of gas does not stop. The pressure should not be set too high, in that disruptions can occur if the flow of gas becomes too vigorous, especially once the end of the conduit is submerged below the level of water in the borehole.

When the end of the conduit 3 has been lowered to the correct depth, an appropriate one of the valves 12 is opened, and the bentonite, sand, etc. from the respective hopper enters the conduit, and is borne down in to the borehole.

First, however, the pressure in the hopper is set by means of pressure regulator 27, and the pressure is admitted into the hopper via on/off valve 29.

When the correct quantity of material has been deposited, that valve 12 is closed. Next, the valve of one of the other hoppers is opened, in order to feed one of the other materials into the borehole.

The conduit may be withdrawn progressively as the level of material rises in the borehole. Bentonite material swells upon contact with water, filling the borehole, and becoming an impermeable barrier, having the consistency of a thick paste. The conduit should not be allowed to remain embedded in bentonite whilst the bentonite is changing its state in this manner, because the swelling bentonite might tend to grip the conduit, and prevent its easy withdrawal, and because withdrawing the conduit through bentonite which has already started to swell can cause disruptions in the bentonite which might compromise its effectiveness as a leak-proof barrier. However, bentonite expands slowly enough that there is generally ample opportunity to keep the bottom end of the conduit out of the gradually-swelling material.

Throughout the operations of feeding the material into the borehole, changing over form hopper to hopper, and of withdrawing the conduit 3 from the borehole, the pressure and velocity of flow of gas in the conduit is maintained. There should be no interruption in the flow, since then water might enter the conduit and wet the inside of the conduit, to which the bentonite particles might then adhere. It will be noted that the materials can be changed and the hoppers can be re-filled, without any change in the flow of gas through the conduit.

The aim of the operator is to deposit the granular material smoothly and consistently into the borehole. The operator consequently should seek to deposit the material as gently as possible upon the material that has been already deposited. The pressure of the gas should be adjusted, and should keep on being adjusted, to correspond to the head of the water in which the conduit is immersed. If the gas flow emerges at too high a pressure, the disruption caused by the vigor of the resulting bubbles can blow the material about in the hole, which makes for inaccuracies. The pressure must be kept high enough to make sure the flow emerges from the end of the conduit, but the pressure should be only marginally higher than this value: of course, the pressure required to just keep the flow gas emerging form the end of the conduit is proportional to the pressure head of the water in which the conduit is submerged.

For proper operation of the apparatus, whenever the valve 12 is opened, the pressure in the hopper 5 (via the pipe 7) should be maintained. Therefore, the lid 9 (FIG. 2) of the hopper should not be opened whilst the valve 12 is open. However, when the valve 12 is closed, the lid 9 may be opened (having first released the pressure in the pipe 7) to allow more material to then be admitted into the hopper. When the hopper has been re-filled, the lid is closed, and the pressure in the pipe 7 restored. When the valve of that hopper is once again opened, the new material can be admitted into the conduit. Thus, the hopper may be refilled, even by a somewhat careless person, without any effect on the continuity of the flow of gas in the conduit.

In FIG. 1, an air-lock re-filling system 19 for the hopper is fitted in place of a simple lid 9, which allows the hopper to be replenished while pressure in the hopper is maintained.

By providing a number of hoppers in parallel, all feeding into the conduit 3, each with its own control valve 12, the materials can be selected and changed, and hoppers can be re-filled, all without compromising the velocity and volume of the flow of gas in the conduit.

By pressurizing those hoppers, and by properly configuring the junction between the conduit and the fall pipe, the gas in the conduit can be prevented from swirling up into the fall pipe.

Figure 3:
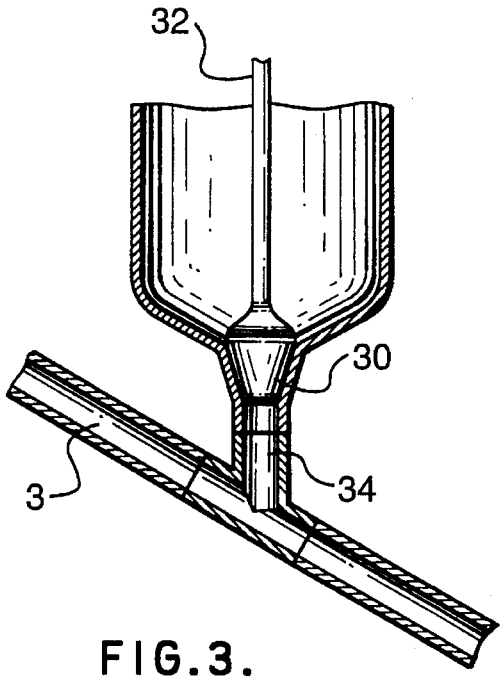
FIG. 3 is a view corresponding to FIG. 2 of an alternative system.

FIG. 3 shows a variation in the layout of the fall pipe and valve area. Here, the valve member 30 is operated by means of a rod 32 which passes up through the hopper. For access for operation of the valve, the rod emerges through the roof of the hopper, to which the rod is sealed. Once past the valve member 30, the material falls into the fall pipe 34, and proceeds as in FIG. 2.

Figure 4:
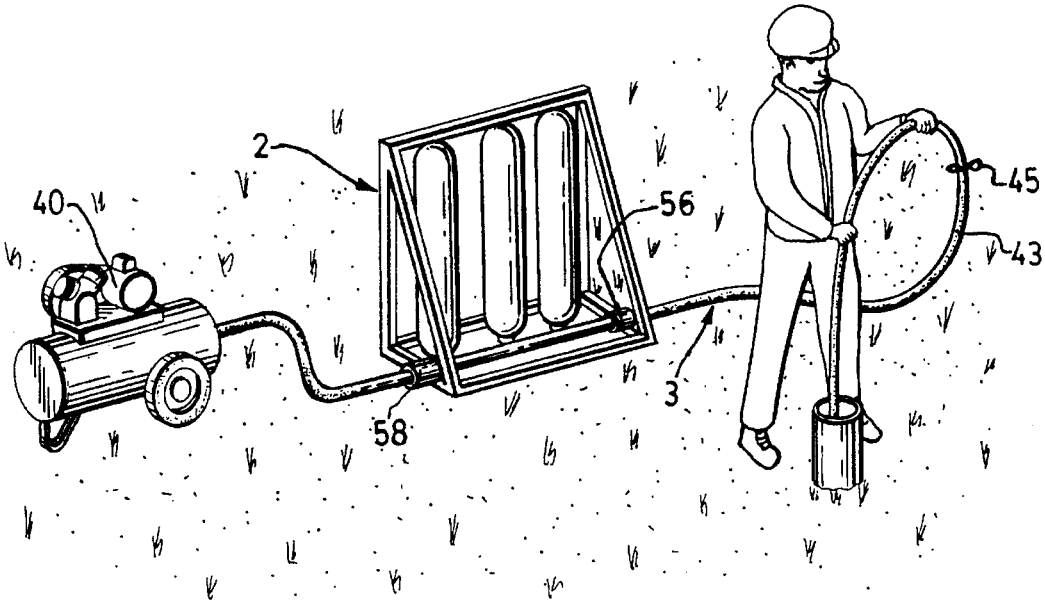
FIG. 4 is a pictorial view of a technician inserting a component of a particle placement system into a borehole.

FIG. 4 shows a technician engaged in drawing a down-hole portion 43 of the conduit 3 gradually out of the borehole.

The apparatus may be used to deposit sand in the borehole. Sand is of such a consistency that the technician can "feel" the level of the sand he is depositing in the borehole; that is to say, if he does not withdraw the down-hole portion 43 rapidly enough, commensurate with the flow rate of the sand being deposited, the bottom end of the down-hole portion becomes buried in the deposited sand. This causes changes in the air pressure, and in the flow rate of the material, which can be sensed above ground.

Burying the end of the conduit reduces the effective weight of the down-hole portion 43; this reduction can be sensed if the technician is holding the down-hole portion of the conduit in his hands, as shown. Also again, burying the bottom end of the conduit causes a reduction in the flow rate of the sand, which again can be felt, if the technician is holding the conduit in his hands, and such a reduction can also be heard.

The material for the down-hole portion of the conduit should be selected on the basis that the conduit should be flexible and light enough for the technician to handle many meters of the conduit, in his hands. The material should be of such consistency that the technician can sense changes in the flow rate of the material being transported in the conduit. It has been found that conventional polyethylene tubing serves well: nylon has been found to be unsuitable, because it leads to a build up of static electricity.

When the injected material is sand, it is a fairly simple matter for the operator, with a little practice, to be able to draw the down-hole portion of the conduit out of the borehole at virtually exactly the rate the sand is being deposited into the borehole. The technician from time to time checks that the end of the down-hole portion of the conduit is just above the deposited level of the sand, which he does by deliberately touching the end into the sand, an occurrence which he can immediately sense. In fact, a skilled technician can "feel" his way up the borehole by sensing the various parameters at depths even down to 60 or 70 meters.

It may be noted that it is a great advantage that the operator has this ability to sense, by feel, the on-going progress of the deposition of material in the borehole.

When the injected material is bentonite, on the other hand, the depth is only about 10 meters, down to which the technician can fell or otherwise sense the parameters that indicate the level of the already-deposited bentonite. This is not to say that below those depths it becomes impossible for the technician to sense the depth of the deposited material, but rather that increasing demands are placed on the skill of the technician.

Below the depths of simple manual sensing (typically, 10 m with bentonite, 60 m with sand), emphasis should rather be placed on measurement or reckoning methods. It is recognized that such method can be carried out quite accurately. The technician can readily measure the quantity of material injected form the hopper, and he can measure the depth to which the down-hole portion of the conduit has been withdrawn out of the borehole. It is often helpful to place marks, as at 45 (FIG. 4) on the down-hole portion 40 of the conduit, to assist the technician in placing the layer to the correct depths. The conduit may alternatively be provided with a scale.

As mentioned, it is important, when bentonite is being deposited in the borehole, that the flow of air or gas does not stop. If the flow stops, and wet bentonite is allowed to expand in the conduit, often the only solution is to draw the conduit to the surface and cut off the plugged end of the conduit. This is tiresome in itself, and of course it affects any depth measurements made using the conduit.

But even a skilled operator can sometimes inadvertently leave the conduit immersed for too long in already deposited bentonite, particularly at deep depths where it is difficult to sense by feel the forces acting on the conduit. Keeping one of the hoppers 50 filled with compressed air is useful in this case, in that as soon as the operator feels that a blockage is starting to build up, he can quickly open that hopper, and dump a large volume of compressed air into the conduit. Hopefully, this sudden blast will dislodge the blockage, whereby the operation of depositing the material in the borehole can then proceed smoothly, although it will often be advantageous to allow a period for the blasted material to settle gently back onto the already-deposited material.

The hopper unit 2 is a contained assembly, having the hoppers, valves, regulators, etc., as described, all housed together for the user's convenience.

Compressed air from a pressure-bottle or from a motorized air compressor 40 is connected to the unit via a coupling 56. Similarly, the down-hole portion 43 of the conduit is coupled to the unit 2 via a coupling 58.

A conventional unit 59 for removing moisture from the compressed air is also provided. It is common for designers of compressed air systems in general also to provide a unit for adding a mist of lubricant into the air: that must not be done in this case, because the presence of such lubricant in a sample of water from the borehole might cause a wrongful assessment that the borehole is contaminated. A conventional air filter is included, whereby the air supplied down the borehole is rendered clean and dry, to whatever standard is dictated by the circumstances.

Boreholes are often at sites where access is limited, but the hopper unit 2 is easily transportable, and can be readily set up at the site with a minimum of site-specific preparation.

As mentioned, a blast of compressed air or gas can be dumped into the conduit to clear down-hole blockages or potential blockages. The hopper 50 containing the gas should be the hopper furthest from the down-hole portion 43 of the conduit, so that the blast can also clear out the portion of the conduit lying under the other hoppers. A check valve 60 should be placed upstream of that hopper, and before admitting the blast of compressed air into the conduit, the technician should see to it that the valves 12 of all the other hoppers are closed, to prevent the surge of pressure from blowing into the other hoppers.

It may be noted that because the reservoir of compressed air is stored in the hopper 50, and is available for blasting out blockages, the operator can afford to keep testing the depth of the conduit by allowing the conduit to start to bury itself in the deposited material. Therefore the operator can apply his skill to accurately maintain the conduit at the desired depth. By contrast, if the consequences of allowing the conduit to become buried were that the conduit had to be brought to the surface and the blocked end cut off, that would be so tiresome that the operator would not dare to keep testing the depth of the conduit, with the result that sometimes he would be depositing material from too high above the already-deposited material. It is one of the major benefits of the invention that material can be deposited gently and directly, from just above, onto the already-deposited material.

Sometimes, the granular material might not flow freely out of the hopper. It is possible, even with sand, that the material could from a "bridge" over the outlet to the hopper, and such bridging is even more possible with bentonite. A vibrator 63 is provided, which acts to shake such bridges loose. The vibrator 63 can be kept on all the time, or can be switched on when flow of the material starts to decrease.

When material is flowing into the conduit from one of the hoppers, it is sometimes found that the flow of gas entering the hopper is rather greater than the flow of gas entering the conduit. However, the flow of gas entering the conduit itself must not be stopped: it is this flow which keeps the water from entering the down-hole end of the conduit when the hopper is closed.

FIGS. 5A, 5B, 5C illustrate diagrammatically some of the different applications of the invention. In FIG. 5A, a single draw-off tube is embedded in sand, and the borehole is backfilled with sand above the draw-off point. The work of back-filling the borehole has been completed, and the apparatus removed.

In FIG. 5B, three draw-off tubes 65 have been provided, each embedded in a respective bed of sand 67, the beds of sand being isolated and sealed from each other by layers of bentonite 69. The draw-off tubes 65 remain permanently embedded in the borehole, and are used e.g. for extracting water samples form the various depths. The down-hole portion 43 of the conduit can be seen in FIG. 5B, the borehole having been backfilled with the layers of sand and bentonite, up to the bottom of the conduit.

In FIG. 5C, an injection of bentonite is being done through a hollow-stem-auger 70. In FIG. 5C, a single draw-off tube 65 is embedded in a layer of sand 67, which is sealed above with bentonite 69. The auger 70 is withdrawn at the same rate of withdrawal as the down-hole portion 43 of the conduit, in correspondence to the rate of fill of the bentonite.

We claim:

1. Operable system for placing granular material below ground in a borehole, wherein:

the system includes a hopper, which contains a quantity of the granular material;

the system includes a conduit, which is connected to a gas supply means;

the conduit extends down from the ground surface into the borehole and a down-hole portion of the conduit is located in the borehole;

the conduit is connected to the hopper in such a manner that, during operation, granular material from the hopper is borne by the gas along the conduit, out of a lower end of the conduit, and into the borehole;

during operation, the borehole contains a level of water, and the lower end of the conduit lies below the level of the water;

the conduit is of such a nature that, during operation, the conduit can be mechanically withdrawn up and out of the borehole from the ground surface by manipulation of the conduit upwards from outside the borehole;

the system includes a hopper support means for supporting the hopper;

the hopper support means is effective to support the hopper, during operation, at a location adjacent to the top of the borehole at the ground surface, but spaced away from the top of the borehole far enough to allow the conduit to be withdrawn up and out of the borehole;

the conduit is so flexible in relation to the hopper that, during operation, the conduit can be manipulated upwards and out of the borehole while the hopper remains undisturbed in its location adjacent to the top of the borehole;

the gas supply means is effective to supply the gas at a pressure of the gas in the conduit that is:

large enough that the gas bubbles out of the lower end of the pipe;

large enough that the conduit is filled with enough pressurized gas to substantially prevent the ingress of water from the borehole into the conduit;

large enough that the granular material passes out of the lower end of the conduit, thereby forming a level of granular material in the borehole, below the level of the water;

and at such a small pressure that the granular material falls gently out of the end of the pipe and settles gently on the material already deposited below the level of the water in the borehole.

2. System of claim 1, wherein the down-hole-portion of the conduit is flexible to the extent that the down-hole-portion, upon being withdrawn from the borehole, can be folded or coiled at the ground surface, while still conveying pressurized gas and granular material therethrough.

3. System of claim 1, wherein the down-hole-portion of the conduit is so constructed and arranged that the down-hole-portion can be fed down into, and can be withdrawn progressively out of, the borehole, by manual manipulation of the conduit by a person holding the conduit in his hands, while leaving the hopper undisturbed in the hopper-support-means.

4. System of claim 1, wherein the hopper comprises a pressure-tight vessel, and the apparatus includes, at a pressure connection-port of the hopper, a means for receiving pressurized gas from the gas supply means into the hopper.

5. System of claim 4, wherein the hopper and the conduit are provided with a respective means for regulating the pressure therein.

6. System of claim 5, wherein the apparatus includes two or more hoppers, each of which is provided with a respective means for regulating the pressure therein.

7. System of claim 1, wherein the down-hole-portion of the conduit is provided with depth-indicating-marks, whereby a person may determine the length of the down-hole-portion remaining in the borehole.

8. System of claim 1, wherein:

the system includes two or more of the said hoppers, each with a respective material-discharge-means, and arranged so that respective granular material in each hopper can be discharged independently into the conduit;

each of the material-discharge-means of the respective hoppers has a respective material-discharge-control-valve, which is operable by a person, by means of which the person may control the independent discharge of the granular material from the hoppers into the conduit, and by means of which the person may permit the discharge of granular material from a selected one of the hoppers into the conduit, while simultaneously preventing the discharge of granular material into the conduit from the other hopper or hoppers.

9. System of claim 8, wherein the system includes two of the said hoppers, and the granular material in one of the two hoppers is bentonite or other sealant material, and the granular material in the other of the two hoppers is sand or other inert filler material.

10. System of claim 1, wherein the system includes, in addition to the gas supply means, also a reservoir that is capable of containing a substantial quantity of pressurized gas, a means for filling the reservoir with gas from the gas supply means, and a means for dumping the said gas into the conduit, while simultaneously preventing the discharge of the said gas into the other hoppers.

11. System of claim 1, wherein:

the system includes a material-discharge-pipe, for allowing passage of the granular material from the hopper through the discharge-pipe, and out of the mouth of the discharge-pipe;

the system includes a junction between the conduit and the discharge-pipe, which is so arranged that granular material passing out of the mouth of the discharge-pipe enters the conduit;

the junction is located in the conduit between the down-hole-portion thereof and the pressure-connection-port;

and the nature of the conduit is such that the granular material entering the conduit form the mouth of the discharge-pipe is borne, by the gas, along the conduit and into, through, and out of, the down-hole-portion of the conduit;

the system includes a material-discharge-control-valve, located in the material-discharge-pipe, and operable between open and closed conditions;

when open, the valve is effective to allow passage of the granular material from the hopper through the discharge-pipe, and out of the mouth of the discharge-pipe;

when closed, the valve is effective to prevent passage of the granular material out of the mouth of the discharge-pipe;

and the junction is so positioned that the conduit remains open to the conduction of gas along the conduit, whether the material-discharge-control-valve in the discharge-pipe is open or closed.

12. System of claim 10, wherein the reservoir is connected to the conduit via a connecting pipe, and the means for dumping the gas into the conduit comprises an operable valve located in the connecting pipe.

13. System of claim 12, wherein:

the hopper includes a material-discharge-means, arranged so the granular material in the hopper can be discharged thereby into the conduit;

the material-discharge-means has a material-discharge-control-valve, which is operable by a person, by means of which:

the person may control the discharge of the granular material from the hopper into the conduit;

the person may permit the discharge of granular material from a selected one of the hoppers into the conduit, while simultaneously preventing the dumping of compressed gas from the reservoir into the conduit;

and by means of which the person may permit the dumping of compressed gas form the reservoir into the conduit, while simultaneously preventing the discharge of granular material form the hopper into the conduit.

14. System of claim 13, wherein the connecting pipe of the reservoir, and the material-discharge-means of the hopper are so located in relation to the conduit that the connecting pipe is located further along the conduit away from the down-hole portion than the material-discharge-means.

15. System of claim 3, wherein the conduit and other components of the system are such that the person holding the conduit in his hands can sense the movement of granular material along the conduit, and can sense changes in the flow rate of the granular material along the conduit to the extent that the person can determine whether a constriction or blockage of the conduit has occurred.

16. Procedure for placing granular material in a borehole, wherein the procedure includes the steps of:

coupling a conduit to a source of compressed gas;

passing the conduit down in to the borehole, with the compressed gas blowing through the conduit and out of an open lower end of the conduit;

providing a hopper of granular material;

transferring the granular material form the hopper into the gas stream in the conduit, in such manner that the granular material in borne down the conduit with the gas and passes out of the lower end thereof, and into the borehole;

arranging and adapting the conduit such that the conduit can be mechanically withdrawn up and out of the borehole form the ground surface, by manipulation of the conduit upwards from outside the borehole;

locating he hopper adjacent to the top of the borehole at the ground surface, but spaced away form the top of the borehole far enough to allow the conduit to be manipulated and withdrawn up and out of the borehole;

arranging the flexibility of the conduit in relation to the hopper in such a manner that, while the material is passing down the conduit, the conduit can be manipulated upwards and out of the borehole while the hopper remains stationary in its location adjacent to the top of the borehole;

as the level of the granular material in the borehole rises, withdrawing the conduit up the borehole, at a rate whereby the lower end of the conduit substantially keeps pace with the rising level of the deposited material;

adjusting and maintaining such a small pressure of gas in the conduit that the granular material falls gently out of the lower end of the conduit, and settles gently on the already deposited material;

wherein the borehole contains a level of water, and the procedure includes the step of adjusting and maintaining such a large pressure of gas in the conduit that, upon immersion of the lower end of the conduit into the water present in the borehole, the gas bubbles out of the lower end of the conduit and the conduit is filled with enough pressurized gas to substantially prevent the ingress of water from the borehole into the conduit.

17. Procedure of claim 16, wherein the procedure includes the steps of:

providing, at the ground surface, a reservoir containing a large volume of pressurized gas;

and, in response to the detection of a constriction or blockage in the conduit, of dumping the said gas from the reservoir into the conduit, substantially suddenly.

18. Procedure for placing granular material below ground in a borehole, being a borehole which contains a level of water, wherein the procedure includes the steps of:

providing a hopper, and providing a quantity of the granular material in the hopper;

providing a conduit, connected to a gas supply means;

the conduit extends down form the ground surface into the borehole, and a down-hole portion of the conduit is located in the borehole;

connecting the conduit to the hopper in such a manner that granular material from the hopper is borne by the gas along the conduit, out of a lower end of the conduit, and into the borehole;

placing the lower end of the conduit below the level of the water;

providing a hopper support means for supporting the hopper, and locating the hopper support means at a location adjacent to the top of the borehole at the ground surface, but spaced away from the top of the borehole far enough to allow the conduit to be withdrawn up and out of the borehole, while the material is passing down the conduit;

supplying gas to the conduit at a pressure of the gas in the conduit which is:

large enough that the gas bubbles out the lower end of the pipe;

large enough that the conduit is filled with enough pressurized gas to substantially prevent the ingress of water from the borehole into the conduit;

large enough that the granular material passes out of the lower end of the conduit, thereby forming a level of granular material in the borehole, below the level of the water;

and small enough that the granular material falls gently out of the end of the pipe and settles gently on the material already deposited below the level of the water in the borehole;

and withdrawing the conduit upwards and out of the borehole, progressively and in response to a rising of the level of the material already deposited below the water level.

19. Procedure of claim 18, comprising the further step of timing the withdrawal of the conduit in relation to the rising of the level of the already-deposited material such that the lower end of the conduit remains just clear of the already-deposited material.

* * * * *